US009327502B2

(12) United States Patent
Horiguchi

(10) Patent No.: US 9,327,502 B2
(45) Date of Patent: May 3, 2016

(54) METHOD OF MANUFACTURING HEAD CHIP

(71) Applicant: SII PRINTEK INC., Chiba (JP)

(72) Inventor: Satoshi Horiguchi, Chiba (JP)

(73) Assignee: SII PRINTEK INC. (JP)

( * ) Notice: Subject to any disclaimer, the term of this patent is extended or adjusted under 35 U.S.C. 154(b) by 143 days.

(21) Appl. No.: 14/149,572

(22) Filed: Jan. 7, 2014

(65) Prior Publication Data

US 2014/0194039 A1 Jul. 10, 2014

(30) Foreign Application Priority Data

Jan. 9, 2013 (JP) ..... 2013-002084

(51) Int. Cl.
*B41J 2/16* (2006.01)

(52) U.S. Cl.
CPC ..... *B41J 2/1632* (2013.01); *B41J 2/1609* (2013.01); *B41J 2/1623* (2013.01); *B41J 2/1631* (2013.01)

(58) Field of Classification Search
CPC ..... B41J 2/16; B41J 2/1609; B41J 2/1623; B41J 2/1631; B41J 2/1632; B41J 2/1634; H01K 3/10
USPC ..... 451/28, 54, 55, 57; 29/890.1; 205/205
See application file for complete search history.

(56) References Cited

U.S. PATENT DOCUMENTS 5,560,090 A * 10/1996 Komakine ..... B41J 2/1609 29/25.35
6,257,700 B1 * 7/2001 Aihara ..... B41J 2/14233 347/44
7,370,415 B2 * 5/2008 Kikugawa ..... B41J 2/1609 205/126
7,757,395 B2 * 7/2010 Watanabe ..... B41J 2/1609 174/262
2005/0062805 A1 * 3/2005 Ito ..... B41J 2/14209 347/71

FOREIGN PATENT DOCUMENTS

JP 2012171290 9/2012

* cited by examiner

*Primary Examiner* — Eileen Morgan
(74) *Attorney, Agent, or Firm* — Adams & Wilks

(57) ABSTRACT

A method of manufacturing a head chip includes a groove forming step for forming grooves which are the bases of ejection grooves on a first surface of the actuator substrate, a substrate grinding step for grinding a second surface of the actuator substrate so that each of the grooves has a predetermined depth, a recessed portion forming step for forming an inspection recessed portion which changes its state in the second surface of the actuator substrate according to the grinding amount of the actuator substrate in the substrate grinding step, and a grinding amount determination step for determining the grinding amount of the actuator substrate on the basis of a state of the inspection recessed portion after the substrate grinding step.

10 Claims, 15 Drawing Sheets

METHOD OF MANUFACTURING HEAD CHIP

BACKGROUND

1. Technical Field

The present invention relates to a method of manufacturing a head chip of a liquid jet head which ejects liquid droplets.

2. Related Art

Conventionally, in an actuator plate used in a head chip of a liquid jet head, a plurality of grooves are formed on one surface of an actuator substrate (piezoelectric substrate) by a dicer or the like, and the other surface of the actuator substrate is then ground to form a plurality of ejection grooves each having a predetermined depth.

JP 2012-171290A discloses a technique for forming ejection grooves and non-ejection grooves in a so-called edge shoot type head chip in which nozzle holes are arranged on the distal ends in the longitudinal direction of the ejection grooves. The technique includes a step for grinding one surface of an actuator substrate that has a plurality of grooves formed on the other surface thereof, and forms ejection grooves and non-ejection grooves from the plurality of grooves formed on the actuator substrate by this step.

SUMMARY

When grinding the surface of the actuator substrate, the surface not having the grooves formed thereon, variation in the depth of the grooves after the grinding may occur. This variation in the depth of the grooves after the grinding results in variation in the depth of the ejection grooves. Especially in a side shoot type head chip in which each nozzle hole communicates with the middle part in the longitudinal direction of each ejection groove, the variation in the depth of ejection grooves largely affects the print quality and is therefore undesirable. In order to prevent the variation in the depth of the grooves after the grinding, it is desired to actually inspect whether or not the grinding amount of the actuator substrate is appropriate without relying only on the setting of a grinding condition.

However, the above conventional technique does not disclose a method for inspecting the grinding amount of the actuator substrate. In order to inspect the grinding amount of the actuator substrate, the thickness of the actuator substrate and the depth of each of the ejection grooves after the grinding can be measured. However, if the measurement is performed for all products, the man-hour for manufacturing the head chip disadvantageously increases significantly.

The present invention has been made in view of the above problems, and is directed to make it possible, in a method of manufacturing a head chip that is provided with an actuator plate on which ejection grooves each having a predetermined depth are formed by grinding an actuator substrate, to easily inspect the grinding amount of the actuator substrate.

As a solution to the above problems, the present invention provides a method of manufacturing a head chip that includes: an actuator plate having a plurality of ejection grooves arranged on a first surface of an actuator substrate, each of the grooves having a depth penetrating the actuator substrate; and a nozzle plate placed on a second surface of the actuator plate, the nozzle plate having a plurality of nozzle holes arranged thereon, each of the nozzle holes communicating with a middle part in the longitudinal direction of each of the ejection grooves. The method includes: a groove forming step for forming grooves which are bases of the ejection grooves on the first surface of the actuator substrate; a substrate grinding step for grinding a second surface of the actuator substrate so that each of the grooves has a predetermined depth; a recessed portion forming step for forming at least one inspection recessed portion on the actuator substrate, the at least one inspection recessed portion changing its state in the second surface of the actuator substrate according to a grinding amount of the actuator substrate in the substrate grinding step; and a grinding amount determination step for determining the grinding amount of the actuator substrate on the basis of a state of the at least one inspection recessed portion after the substrate grinding step.

In the present invention, the at least one inspection recessed portion may comprise a plurality of inspection recessed portions, and the inspection recessed portions may be formed on both sides in an arrangement direction of the grooves of a groove group including the grooves.

In this case, the inspection recessed portions may be formed outside outermost grooves of the groove group, or may also be formed inside the outermost grooves of the grove group.

In the present invention, the at least one inspection recessed portion may be formed on the first surface of the actuator substrate.

In this case, the at least one inspection recessed portion may have a bottom that causes an opening width thereof in the second surface of the actuator substrate to increase as the grinding amount of the actuator substrate increases, and the grinding amount of the actuator substrate may be determined on the basis of the opening width of the at least one inspection recessed portion in the second surface of the actuator substrate.

Further, the at least one inspection recessed portion may include a first recessed portion whose bottom is opened when the grinding amount of the actuator substrate reaches a minimum value thereof and a second recessed portion whose bottom remains closed even when the grinding amount of the actuator substrate reaches a maximum value thereof.

Further, the at least one inspection recessed portion may be a second groove which is a base of a non-ejection groove alternately arranged with the ejection grooves.

In the present invention, the at least one inspection recessed portion may be formed on the second surface of the actuator substrate.

In this case, the at least one inspection recessed portion may include a second side first recessed portion which disappears when the grinding amount of the actuator substrate reaches a minimum value thereof and a second side second recessed portion which remains to exist even when the grinding amount of the actuator substrate reaches a maximum value thereof.

According to the present invention, it is possible to easily inspect whether or not the grinding amount of the actuator substrate is appropriate as well as whether or not the depth of each of the ejection grooves is appropriate without inspecting the thickness of the actuator substrate and the depth of each of the ejection grooves after grinding a surface of the actuator substrate, which having no grooves formed thereon, using inspection equipment or the like. Since the grinding amount of the actuator substrate can be easily inspected in this manner, it is possible to reduce variation in the depth of the ejection grooves and achieve an excellent liquid ejection performance while preventing an increase in the man-hour for manufacturing the head chip. When the inspection recessed portions are provided on both sides in the longitudinal direction of the actuator substrate, variation in the depth of the grooves due to an inclination of the actuator substrate can also be easily detected.

DETAILED DESCRIPTION

Hereinbelow, an embodiment of the present invention will be described with reference to the accompanying drawings. In the following embodiment, ahead chip of a liquid jet head which ejects ink as liquid, and a liquid jet recording apparatus provided with the head chip will be described as examples.

Figure 1:
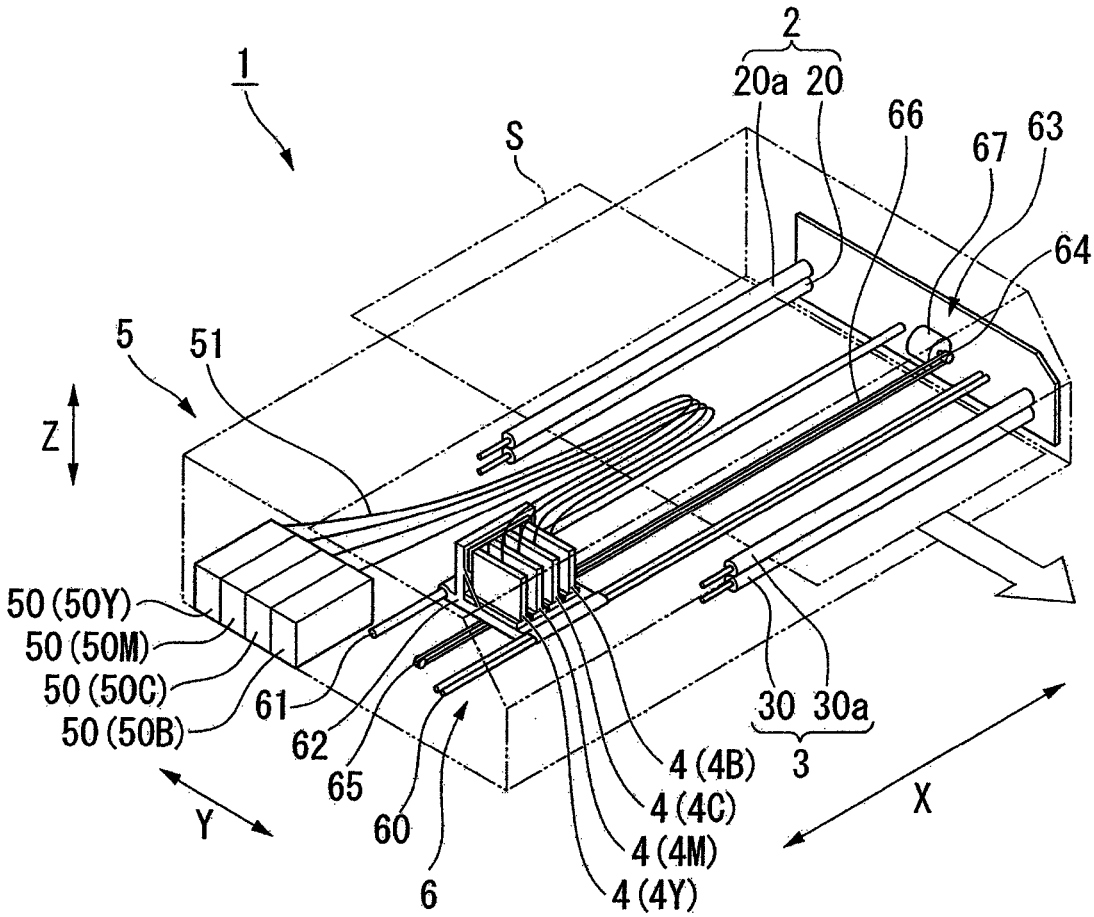
FIG. 1 is a perspective view of a liquid jet recording apparatus that is provided with a liquid jet head including a head chip in an embodiment of the present invention.

As illustrated in FIG. 1, a liquid jet recording apparatus 1 is provided with a pair of conveyance units (recording medium conveyance units) 2 and 3 which conveys a recording medium S such as paper, a liquid jet head 4 which jets ink onto the recording medium S, an ink supply unit (liquid supply unit) 5 which supplies ink to the liquid jet head 4, and a scanning unit 6 which moves the liquid jet head 4 in a direction that is perpendicular to a conveyance direction of the recording medium S, namely, the width direction of the recording medium S. In the following description, the with direction of the recording medium S is referred to as an X direction, and the conveyance direction of the recording medium S is referred to as a Y direction. In FIG. 1, a Z direction indicates the height direction that is perpendicular to the X direction and the Y direction.

The conveyance unit 2 includes a grid roller 20 which extends in the X direction, a pinch roller 20*a* which extends in parallel to the grid roller 20, and a drive mechanism (not shown) such as a motor which rotates the grid roller 20 about the shaft thereof. Similarly, the conveyance unit 3 includes a grid roller 30 which extends in the X direction, a pinch roller 30*a* which extends in parallel to the grid roller 30, and a drive mechanism (not shown) which rotates the grid roller 30 about the shaft thereof.

The ink supply unit 5 includes an ink tank 50 which stores ink therein and an ink pipe 51 which connects the ink tank 50 to the liquid jet head 4. As the ink tank 50, for example, ink tanks 50Y, 50M, 50C, and 50B which respectively store therein four colors of ink, i.e. yellow, magenta, cyan, and black, are arranged in the Y direction. The ink pipe 51 includes a flexible hose having flexibility that can cope with the operation of a carriage 62 which supports the liquid jet head 4.

The scanning unit 6 includes a pair of guide rails 60 and 61 each of which extends in the X direction, the carriage 62 which can slide along the pair of guide rails 60 and 61, and a drive mechanism 63 which moves the carriage 62 in the X direction. The drive mechanism 63 includes a pair of pulleys 64 and 65 which is provided between the guide rail 60 and the guide rail 61, an endless belt 66 which is wound around the pair of pulleys 64 and 65, and a drive motor 67 which drives the pulley 64 to rotate.

The pulley 64 is provided between one end of the guide rail 60 and one end of the guide rail 61, and the pulley 65 is provided between the other end of the guide rail 60 and the other end of the guide rail 61. The endless belt 66 is provided between the guide rail 60 and the guide rail 61. The carriage 62 is coupled to the endless belt 66. The carriage 62 loads thereon a plurality of liquid jet heads 4, namely, liquid jet heads 4Y, 4M, 4C, and 4B which respectively eject four colors of ink, i.e. yellow, magenta, cyan and black, and arranged in the X direction.

The liquid jet head 4 supports one or more head chips 41 (see FIGS. 2 and 3 etc.), and also supports a flow path supply/discharge unit, a filter unit, a wiring board and the like (all of which are not shown), on a base which is fixed to the carriage 62. A control circuit which controls the head chip 41 to drive is formed on the wiring board. The liquid jet head 4 ejects respective colors of ink with a desired volume according to drive signal output by a control device (not shown). The liquid jet head 4 is moved in the X direction by the scanning unit 6 to perform recording on the recording medium S within a predetermined width in the Y direction. Further, the liquid jet head 4 is repeatedly moved in the X direction while conveying the recording medium S in the Y direction by the conveyance units 2 and 3 to perform the recording on the entire recording medium S.

Figure 2:
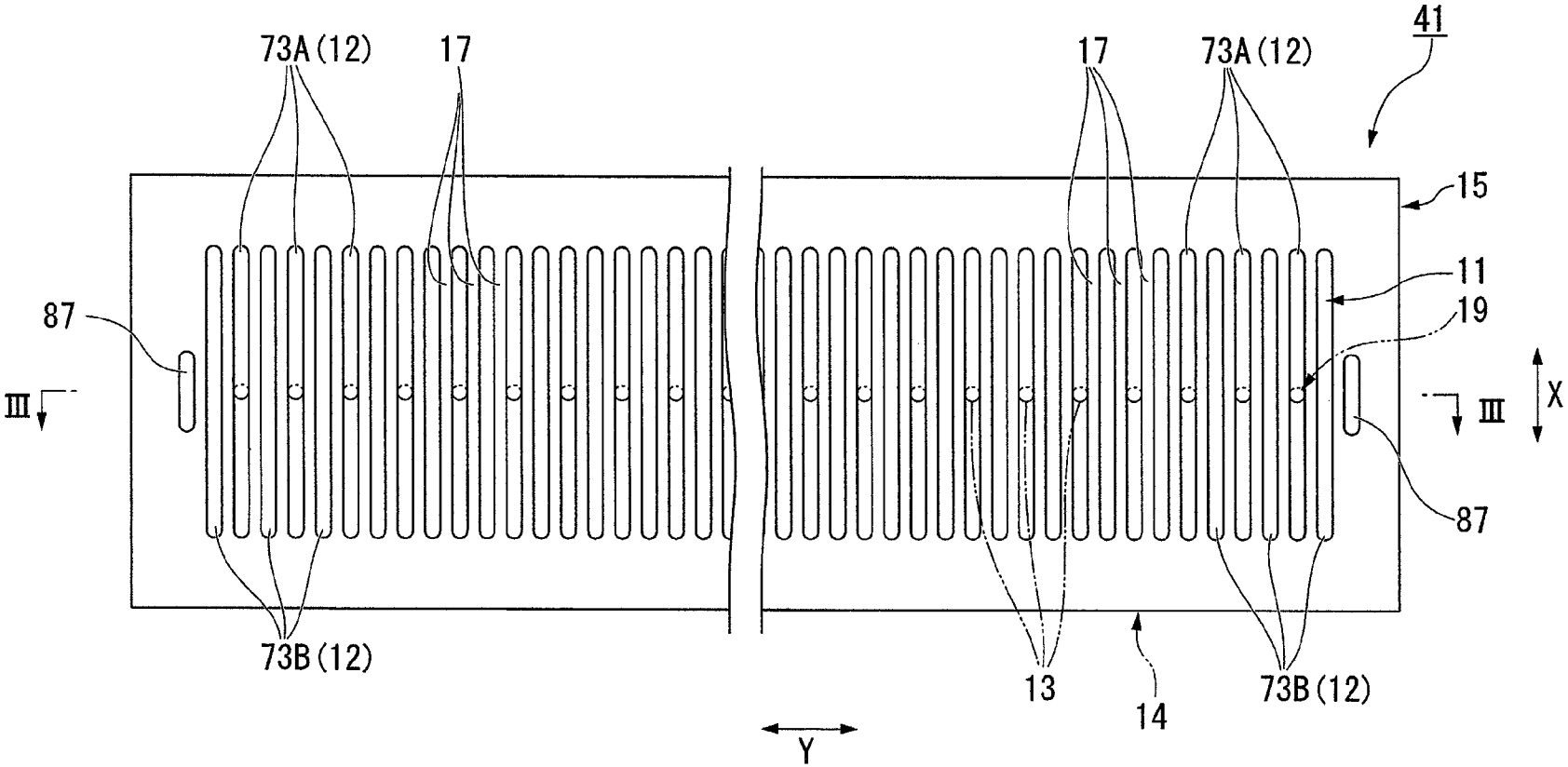
FIG. 2 is plan view of the head chip when viewed from underneath a nozzle plate.
Figure 3:
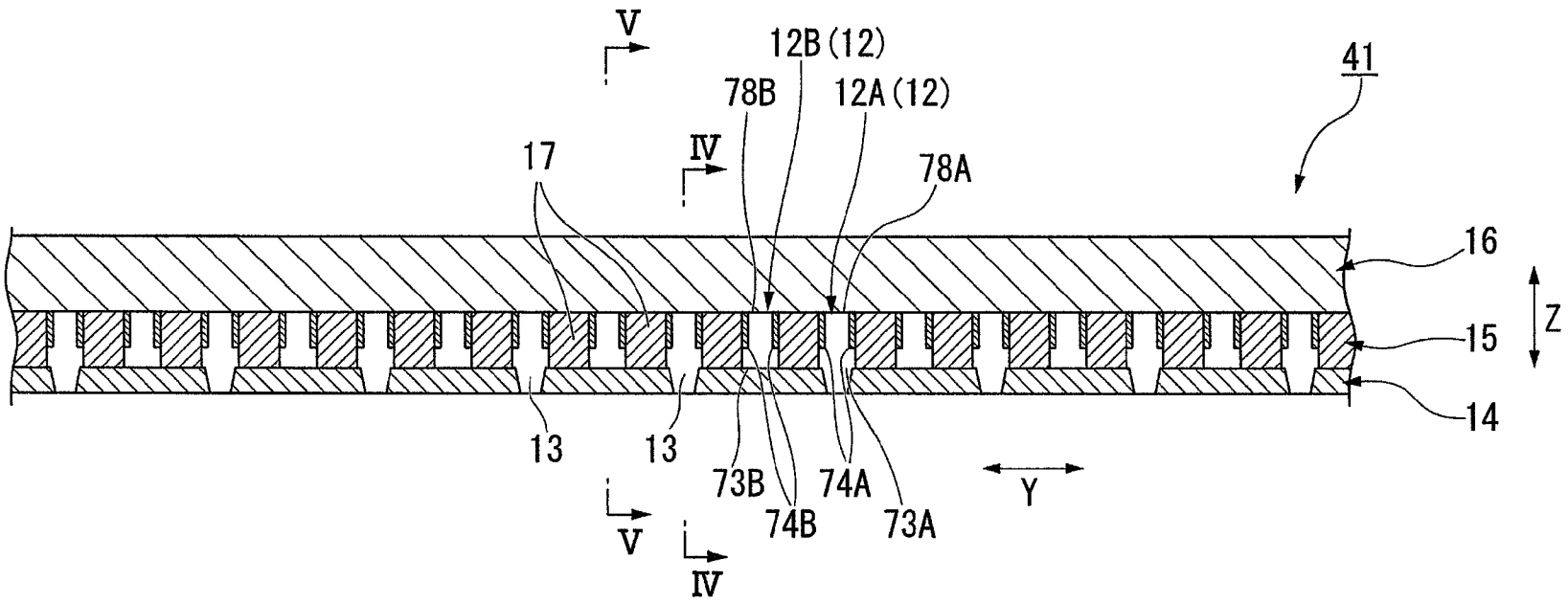
FIG. 3 is a cross-sectional view taken along line of FIG. 2.

As illustrated in FIGS. 2 and 3, the head chip 41 is formed into a band plate that has a predetermined width in the X direction and extends in the Y direction. The head chip 41 is a liquid circulation type head chip which performs supply and discharge of ink with the flow path supply/discharge unit. The head chip 41 ejects ink from a nozzle array 19 which includes a plurality of nozzle holes 13. The nozzle holes 13 are linearly arranged along the Y direction. The head chip 41 is a so-called side shoot type head chip, and ejects ink from the nozzle holes 13 each of which is formed on the center in the longitudinal direction of each of liquid jet channels 12A which will be described later.

The head chip 41 has a laminated structure of an actuator plate 15, a cover plate 16, and a nozzle plate 14 which are integrally provided. The actuator plate 15 has a channel group 11 which includes a plurality of channels (grooves) 12 arranged in parallel to each other. The cover plate 16 is placed on the upper surface (first surface) of the actuator plate 15. The nozzle plate 14 is placed on the lower surface (second surface) of the actuator plate 15. For the convenience of illustration, the nozzle plate 14 is indicated by a two-dot chain line in FIG. 2.

The actuator plate 15 is formed of, for example, lead zirconate titanate (PZT) ceramics which is polarized in the vertical direction. The cover plate 16 is formed of the same PXT ceramics as the actuator plate 15 so that the thermal expansion of the cover plate 16 is made equal to that of the actuator plate 15, thereby preventing warpage and deformation caused by temperature change. The cover plate 16 may be formed of a material that is different from the material of the actuator plate 15. However, the material of the cover plate 16 preferably has a thermal expansion coefficient similar to that of PZT ceramics. The nozzle plate 14 is formed of a translucent polyimide film.

Figure 7:
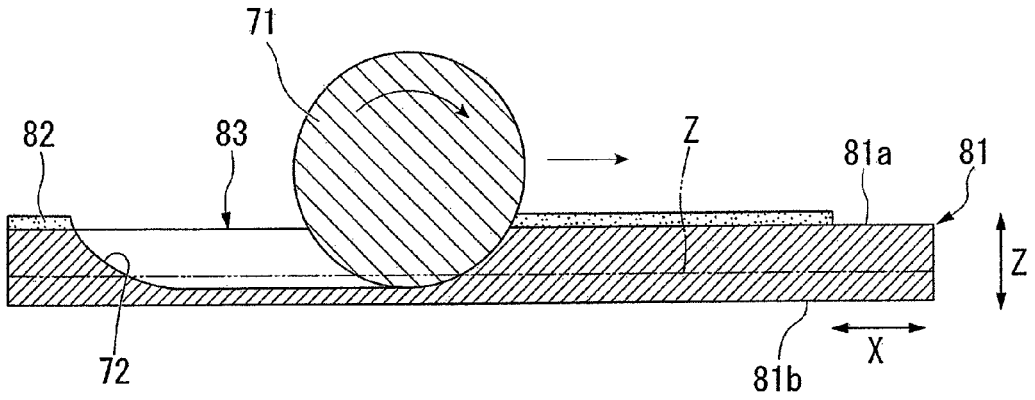
FIG. 7 is a cross-sectional view corresponding to FIG. 4 and FIG. 5 in a groove forming step of the manufacturing method.
Figure 8:
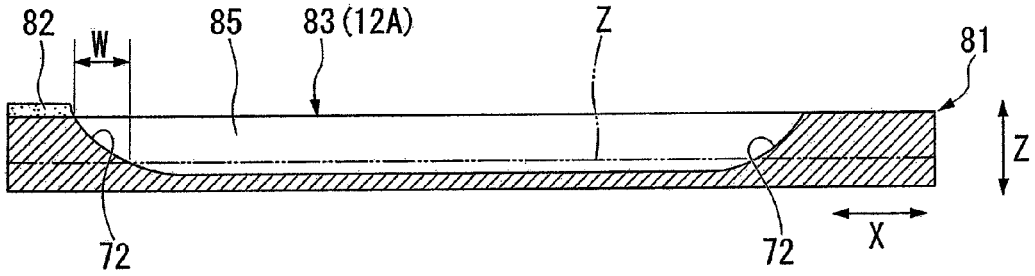
FIG. 8 is a cross-sectional view corresponding to FIG. 4 in the groove forming step.

The channels 12 are linearly formed on the actuator plate 15 at regular intervals by cutting the upper surface of the actuator plate 15 using a dicing blade 71 (see FIG. 7) which will be described later. Each of the channels 12 is formed so as to penetrate the actuator plate 15 from the upper surface through the lower surface thereof excluding regions on both ends in the longitudinal direction (X direction) thereof on which arc-shaped bottom surfaces 72 are formed along the outer peripheral shape of the dicing blade 71. Piezoelectric bodies 17, each of which has a rectangular cross section and extends in the X direction, are formed between adjacent ones of the channels 12. On both ends in an arrangement direction (Y direction) of the channel group 11, inspection recessed portions 87 for inspecting the grinding amount of a piezoelectric substrate 81 in a substrate grinding step S7 which will be describe later are formed.

Each of the channels 12 is roughly classified into a liquid jet channel (ejection groove) 12A that allows ink droplets to be ejected therethrough and a dummy channel (non-ejection groove) 12B that does not allow ink droplets to be ejected therethrough. A plurality of liquid jet channels 12A and a plurality of dummy channels 12B are formed so as to be alternately arranged in the Y direction.

Figure 4:
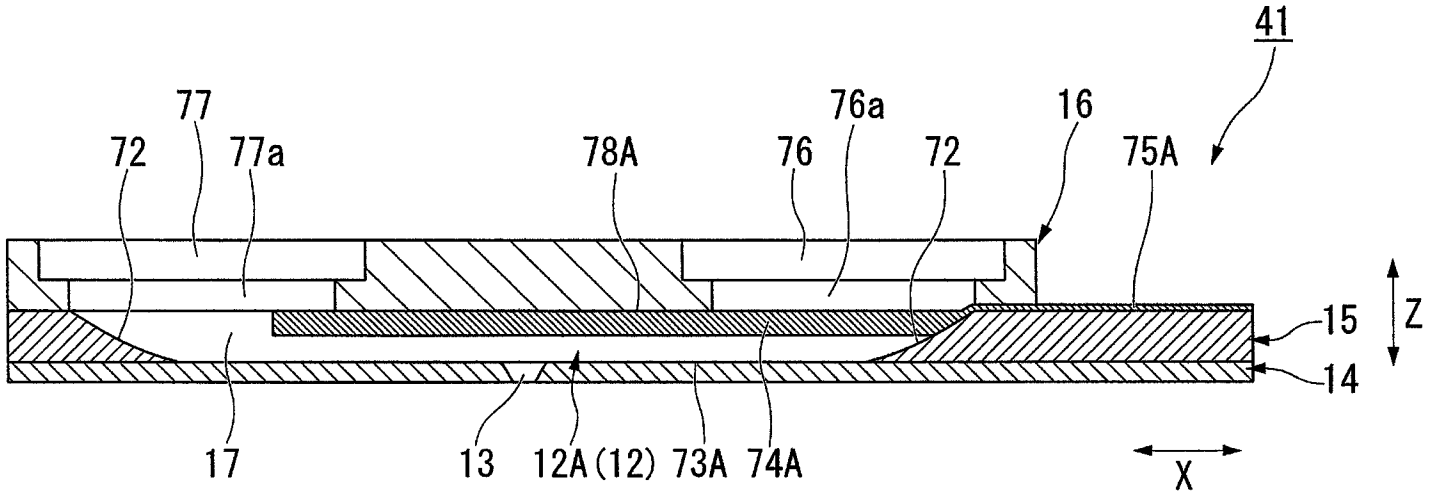
FIG. 4 is a cross-sectional view taken along line IV-IV of FIG. 3.
Figure 5:
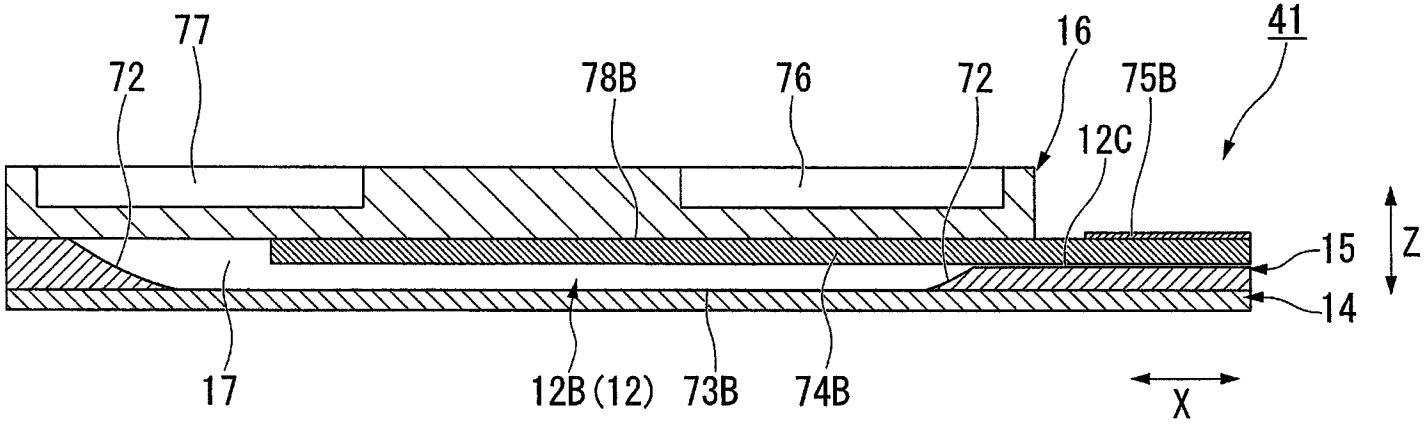
FIG. 5 is a cross-sectional view taken along line V-V of FIG. 3.

As illustrated in FIGS. 4 and 5, a first end of each of the liquid jet channels 12A and the dummy channels 12B, the first end being positioned on a first side in the X direction (a left side in the drawings), is formed in such a manner that the arc-shaped bottom surface 72 formed by the dicing blade 71 terminates at a position that is relatively slightly inward from a first outer end of the actuator plate 15, the first outer end being positioned on the first side in the X direction.

On the other hand, a second end of each of the liquid jet channels 12A and the dummy channels 12B, the second end being positioned on a second side in the X direction (a right side in the drawings) is formed in such a manner that the arc-shaped bottom surface 72 terminates at a position that is relatively largely inward from a second outer end of the actuator plate 15, the second outer end being positioned on the second side in the X direction.

The liquid jet channels 12A and the dummy channels 12B vertically penetrate the actuator plate 15 within the same range as each other in the X direction.

In each of the dummy channels 12B, a shallow groove 12C having a shallow depth in the Z direction is formed in connection to the dummy channel 12B from the position at which the arc-shaped bottom surface 72 on the second end of the dummy channel 12B terminates up to the second outer end of the actuator plate 15.

The bottoms of the liquid jet channels 12A and the dummy channels 12B are blocked by the nozzle plate 14 which is attached to the lower surface of the actuator plate 15.

Referring to FIGS. 2 and 3, the nozzle plate 14 is provided so as to, for example, have the same width in the X direction and the same length in the Y direction as the actuator plate 15. The nozzle plate 14 has the nozzle holes 13 each of which is positioned below the center in the X direction of each of the liquid jet channels 12A and communicates with each of the liquid jet channels 12A.

The nozzle holes 13 are arranged along the Y direction to form a linear nozzle array 19. The nozzle plate 14 is bonded to the lower surface of the actuator plate 15 with adhesive or the like so as to cover the bottoms of the liquid jet channels 12A and the dummy channels 12B (the lower surface of the actuator plate 15). Lower openings 73A of the respective liquid jet channels 12A are blocked by the nozzle plate 14. However, each of the nozzle holes 13 is arranged below the center in the longitudinal direction (the center in the X direction) of each of the liquid jet channels 12A. Lower openings 73B of the respective dummy channels 12B are blocked by regions of the nozzle plate 14 that are positioned between adjacent ones of the nozzle holes 13.

The lower openings 73A of the liquid jet channels 12A and the shape of the lower openings 73B of the dummy channels 12B that are alternately arranged on the lower surface of the actuator plate 15 have the same shape. However, the shape of the lower openings 73A and the shape of the lower openings 73B may be different from each other. Each of the dummy channels 12B may terminate in the same manner as the liquid jet channels 12A without forming the shallow groove 12C in connection therewith. The dummy channels 12B may not be opened on the lower surface of the actuator plate 15.

Referring to FIG. 4, common electrodes 74A are formed on opposing inner side surfaces of each of the liquid jet channels 12A. The common electrodes 74A are separated upward from the bottom surfaces of the liquid jet channels 12A (the upper surface of the nozzle plate 14). Each of the common electrodes 74A is formed into a band form extending in the X direction. Ends of the common electrodes 74A, which are located on the second side in the X direction, are electrically connected to common terminals 75A which are formed on the upper surface of the actuator plate 15 on the second side in the X direction.

Referring to FIG. 5, active electrodes 74B are formed on opposing inner surfaces of each of the dummy channels 12B. The active electrodes 74B are separated upward from the bottom surfaces of the dummy channels 12B (the upper surface of the nozzle plate 14). Each of the active electrodes 74B is formed into a band form extending in the X direction. Ends of the active electrodes 74B, which are located on the second side in the X direction, are electrically connected to active terminals 75B which are formed on the upper surface of the actuator plate 15 on the second side in the X direction.

A pair of active electrodes 74B facing each other in each of the dummy channels 12B are electrically separated from each other. Each of the active electrodes 74B is positioned above the bottom surface of the shallow groove 12C, and formed in connection to an inner surface of the shallow groove 12C. Two active electrodes 74B each of which is formed on each of a pair of piezoelectric bodies 17 that defines a liquid jet channel 12A therebetween are electrically connected to each other.

In this configuration, when a voltage is applied to the active electrodes 74B formed on the pair of piezoelectric bodies 17 that define the liquid jet channel 12A therebetween, the pair of piezoelectric bodies 17 are deformed, which causes pressure fluctuation in ink that is filled inside the liquid jet channel 12A therebetween. The ink is ejected from the corresponding nozzle hole 13 to thereby record a character or a figure on the recording medium S. A flexible substrate (not shown) for connecting the common terminals 75A and the active terminals 75B to the outside is mounted on the actuator plate 15 on the second side in the X direction.

The cover plate 16 is formed into a band plate that extends in the Y direction in the same manner as the actuator plate 15, and has a width narrower than the actuator plate 15 in the X direction and wider than the entire length of the channel group 11 of the liquid jet channels 12A and the dummy channels 12B in the Y direction. The cover plate 16 has a liquid supply chamber 76 which is formed on the upper surface thereof on the second side in the X direction (the right side in the drawings) and a liquid discharge chamber 77 which is formed on the upper surface thereof on the first side in the X direction (the left side in the drawings). First slits 76*a* each of which communicates with each of the liquid jet channels 12A on the second side in the X direction are formed on the bottom (lower part) of the liquid supply chamber 76. Second slits 77*a* each of which communicates with each of the liquid jet channels 12A on the first side in the X direction are formed on the bottom of the liquid discharge chamber 77.

The cover plate 16 is placed in such a manner that a first outer end thereof positioned on the first side in the X direction (the left side in the drawings) is aligned with the first outer end of the actuator plate 15 to cover the liquid jet channels 12A and the dummy channels 12B, and, on the other hand, a second outer end thereof positioned on the second side in the X direction (the right side in the drawings) is arranged so that the common terminals 75A and the active terminals 75B are exposed to the outside. The first slits 76*a* of the cover plate 16 communicate with upper openings 78A of the respective liquid jet channels 12A on the second side in the X direction. The second slits 77*a* of the cover plate 16 communicate with the upper opening 78A of the respective liquid jet channels 12A on the first side in the X direction. Upper openings 78B of the respective dummy channels 12B do not communicate with the first slit 76*a*, the second slit 77*a*, and the like, and are blocked by the lower surface of the cover plate 16.

The cover plate 16 preferably has a thickness in the range of 0.3 to 1.0 mm. The nozzle plate 14 preferably has a thickness in the range of 0.01 to 0.1 mm. When the cover plate 16 is thinner than 0.3 mm, the strength thereof is reduced. On the other hand, when the cover plate 16 is thicker than 1.0 mm, it takes time for the processing of the liquid supply chamber 76 and the liquid discharge chamber 77, and the first and second slits 76*a* and 77*a*. In addition, the manufacturing cost increases due to the increased amount of materials. Further, when the nozzle plate 14 is thinner than 0.01 mm, the strength thereof is reduced. On the other hand, when the nozzle plate 14 is thicker than 0.1 mm, vibration is transmitted between nozzle holes 13 that are adjacent to each other, and crosstalk is thereby likely to occur.

Note that the PZT ceramics has a Young's modulus of 58.48 GPa and the polyimide film has a Young's modulus of 3.4 GPa. That is, the cover plate 16 which covers the upper surface of the actuator plate 15 has a higher stiffness than the nozzle plate 14 which covers the lower surface of the actuator plate 15. The material of the cover plate 16 preferably has a Young's modulus of not less than 40 GPa. The material of the nozzle plate 14 preferably has a Young's modulus in the range of 1.5 to 30 GPa. When the nozzle plate 14 has a Young's modulus of less than 1.5 GPa, the nozzle plate 14 bruises easily when making contact with the recording medium S, and the reliability thereof is therefore reduced. On the other hand, when the nozzle plate 14 has a Young's modulus of more than 30 GPa, vibration is transmitted between nozzle holes 13 that are adjacent to each other, and crosstalk is thereby likely to occur.

The liquid jet head 4 is driven in the following manner. First, ink which has been supplied from the ink supply unit 5 to the liquid supply chamber 76 flows into the liquid jet channels 12A through the first slits 76*a*. Then, the ink flows from the liquid jet channels 12A to the liquid discharge chamber 77 through the second slits 77*a*. When a drive signal is applied to the active electrodes 74B in the state where the ink is supplied to and discharged from the liquid jet channels 12A in this manner, thickness-shear deformation is caused in the piezoelectric bodies 17 which define the respective liquid jet channels 12A. Accordingly, pressure waves are generated in the ink filled inside the liquid jet channels 12A. The ink is ejected from the nozzle holes 13 by the pressure waves to record a character or a figure on the recording medium S. Since the common electrodes 74A and the active electrodes 74B are separated from the bottom surfaces of the liquid jet channels 12A and the dummy channels 12B, namely, the upper surface of the nozzle plate 14, the pressure waves induced in ink are stabilized, thereby enabling ink droplets to be stably ejected. In the present embodiment, the liquid supply chamber 76 is arranged on the same side as the common terminals 75A and the active terminals 75B, and the liquid discharge chamber 77 is arranged on the other side. However, the arrangement of the liquid supply chamber 76 and the liquid discharge chamber 77 may be reversed.

Figure 6:
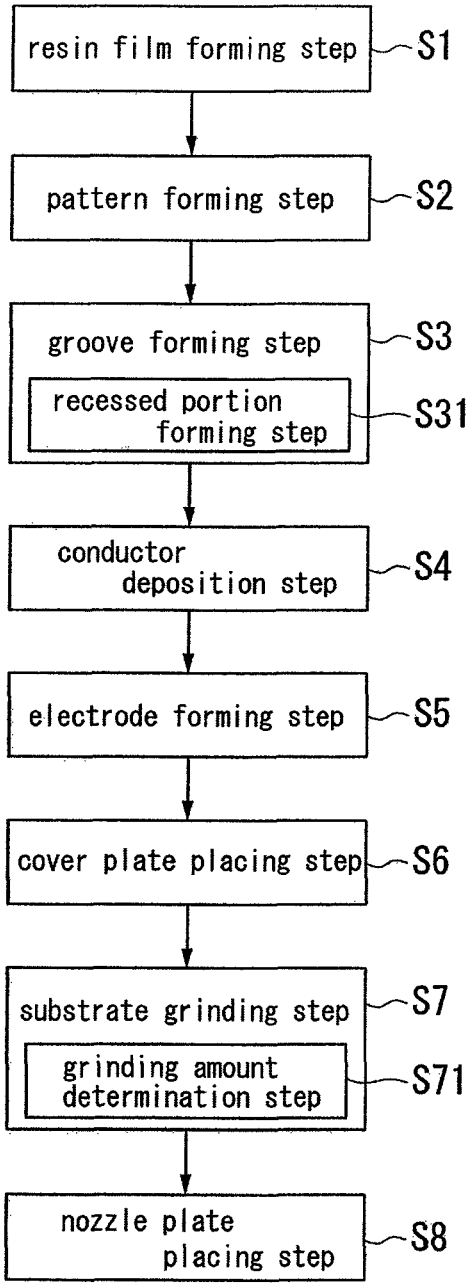
FIG. 6 is a flowchart illustrating main steps of a method of manufacturing the head chip.

FIG. 6 is a flowchart illustrating main steps of a method of manufacturing the head chip 41 in the present embodiment. This method includes a resin film forming step S1 for forming a photosensitive resin film 82 on a first surface (an upper surface in the drawings) of the piezoelectric substrate (actuator substrate) 81 that forms the actuator plate 15; a pattern forming step S2 for forming a pattern of the resin film 82 by exposure and development; a groove forming step S3 for forming a plurality of grooves 83 on the first surface of the piezoelectric substrate 81; a conductor deposition step S4 for vapor-depositing a conductor 84 on the first surface of the piezoelectric substrate 81 from a direction that is inclined toward a direction perpendicular to the longitudinal direction of the grooves 83 with respect to the normal direction of the first surface of the piezoelectric substrate 81; an electrode forming step S5 for forming the common electrodes 74A and the active electrodes 74B by patterning the conductor 84; a cover plate placing step S6 for placing the cover plate 16 on the first surface of the piezoelectric substrate 81; a substrate grinding step S7 for grinding a second surface of the piezoelectric substrate 81; and a nozzle plate placing step S8 for placing the nozzle plate 14 on the ground second surface of the piezoelectric substrate 81.

In the resin film forming step S1, the photosensitive resin film 82 (see FIG. 7) is formed on the upper surface of the piezoelectric substrate 81. The piezoelectric substrate 81 is formed of PZT ceramics. The resin film 82 is formed by applying a resist film onto the piezoelectric substrate 81. The resin film 82 may be formed of a photosensitive resin film.

In the pattern forming step S2, a pattern of the resin film 82 is first formed by exposure and development. Then, a part of the resin film 82 is removed in regions on which the common terminals 75A and the active terminals 75B are to be formed, and the other part of the resin film 82 is left in regions on which the common terminals 75A and the active terminals 75B are not to be formed. The latter part is left in order to later perform patterning of the common terminals 75A and the active terminals 75B by lift-off.

Referring to FIGS. 7 to 10, in the groove forming step S3, the grooves 83 which are the bases of the liquid jet channels 12A and the dummy channels 12B are formed on the piezoelectric substrate 81 by the dicing blade 71. The dicing blade 71 moves downward from a position above the piezoelectric substrate 81 that is horizontally arranged to a position which is to be a first end on the first side in the X direction of each of the grooves 83 on the upper surface of the piezoelectric substrate 81. Then, a part of the piezoelectric substrate 81 on this position is ground by the dicing blade 71 up to a predetermined depth. The predetermined depth is deeper than a final depth of the liquid jet channels 12A and the dummy channels 12B that is formed in the substrate grinding step S7 and is indicated by a two-dot chain line Z, but does not reach the lower surface of the piezoelectric substrate 81.

Then, the dicing blade 71 horizontally moves toward the second side in the X direction along the upper surface of the piezoelectric substrate 81 to form the groove 83 having the predetermined depth. After the dicing blade 71 reaches a position that is to be a second end on the second side in the X direction of the groove 83, the dicing blade 71 moves upward so as to escape from the piezoelectric substrate 81. The dicing blade 71 repeatedly forms each of the grooves 83 while displacing in the Y direction to form the grooves 83 arranged in parallel to each other (see FIG. 11). In this example, all of the grooves 83 have the same depth.

Figure 9:
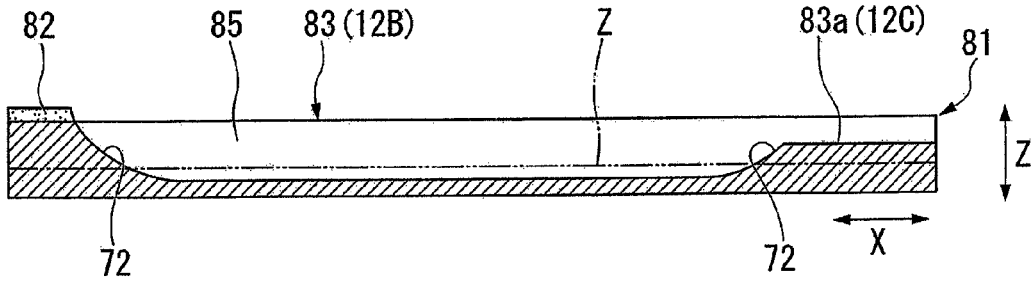
FIG. 9 is a cross-sectional view corresponding to FIG. 5 in the groove forming step.
Figure 10:
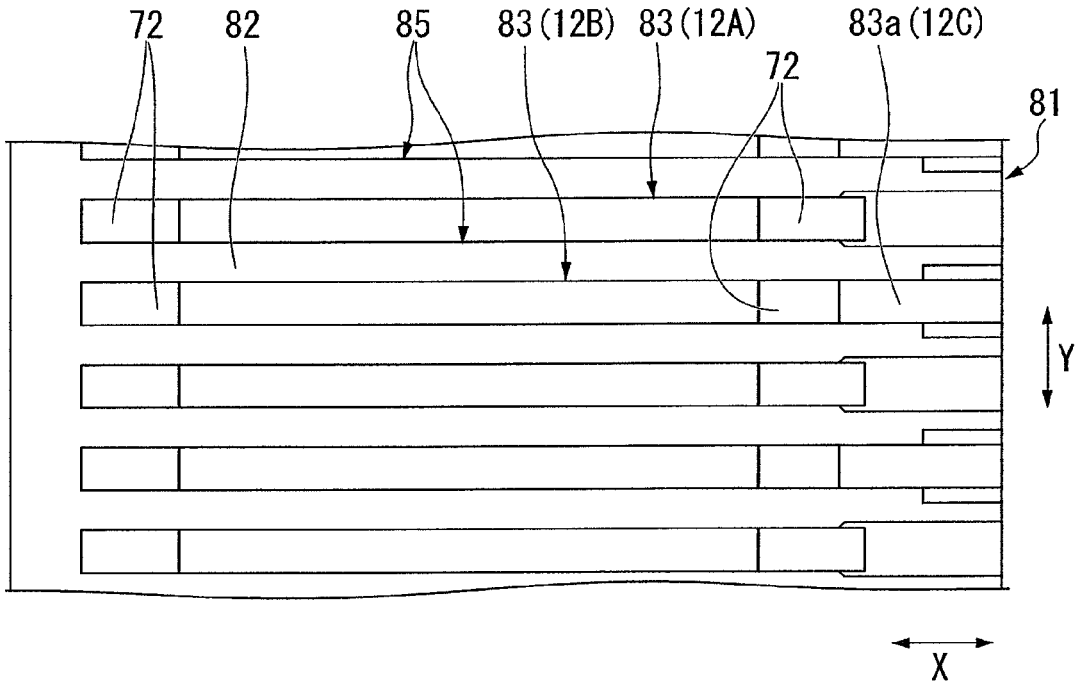
FIG. 10 is a plan view of a piezoelectric substrate in the groove forming step.

Referring to FIG. 9, the dicing blade 71 forms a shallow groove 83*a*, which is the base of the shallow groove 12C, up to an outer end of the piezoelectric substrate 81 on the second side in the X direction, in each of the grooves 83 which are the bases of the dummy channels 12B. The patterned resin film 82 is formed on the upper surface of the piezoelectric substrate 81.

The upper surface of the piezoelectric substrate 81 is ground by the dicing blade 71 up to a depth deeper than the final depth of the liquid jet channels 12A and the dummy channels 12B indicated by the two-dot chain line Z. Accordingly, a width W in the X direction (see FIG. 8) of the arc-shaped bottom surfaces 72 of the liquid jet channels 12A and the dummy channels 12B is made narrow in comparison with the case where the upper surface of the piezoelectric substrate 81 is ground up to the depth indicated by the two-dot chain line Z. This makes it easy to ensure the effective width in the X direction of the liquid jet channels 12A and the dummy channels 12B. As a result, the piezoelectric substrate 81 can be down-sized, and the yield when obtaining the piezoelectric substrate 81 from a piezoelectric body wafer is improved.

The grooves 83 each having a depth penetrating the piezoelectric substrate 81 may be formed by the dicing blade 71 in the groove forming step S3. However, in this case, chipping is likely to occur in an opening of each of the grooves 83 when the dicing blade 71 penetrates the piezoelectric substrate 81. Further, when the piezoelectric substrate 81 is made thin for allowing the grooves 83 to easily penetrate, the strength of the piezoelectric substrate 81 is reduced, and the piezoelectric substrate 81 therefore becomes difficult to handle.

Figure 11:
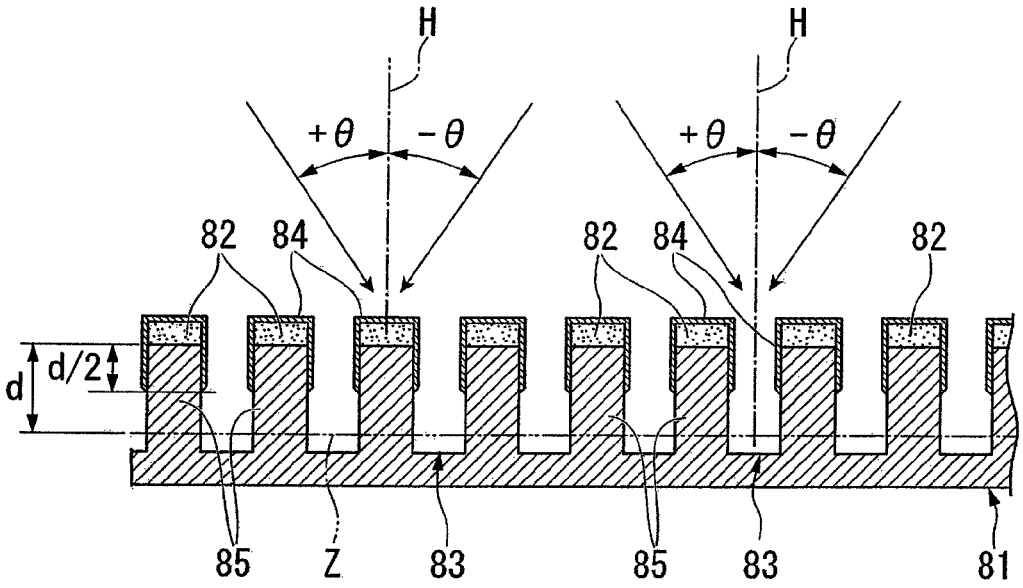
FIG. 11 is a cross-sectional view corresponding to FIG. 3 in a conductor deposition step of the manufacturing method.

Referring to FIG. 11, in the conductor deposition step S4, the conductor 84 is vapor-deposited on the upper surface of the piezoelectric substrate 81 from two directions that are respectively inclined toward a direction perpendicular to the longitudinal direction (X direction) of the grooves 83 by angles $+\theta$ and $-\theta$ with respect to the normal line H of the upper surface of the piezoelectric substrate 81. In the present embodiment, the conductor 84 is deposited up to a depth that is approximately half a depth d (d/2). The depth d is defined as a distance between the upper surfaces of walls 85, which are formed between the grooves 83 and are the bases of the piezoelectric bodies 17, and the two-dot chain line Z.

The lower edge of the conductor 84 is positioned above bottom surfaces of the shallow grooves 83*a*. Therefore, the conductor 84 is not deposited on the bottom surfaces of the shallow grooves 83*a*. On the other hand, in grooves 83 that are the bases of the liquid jet channels 12A, the conductor 84 is deposited in the region shallower than the depth d/2 (see FIG. 13) on the upper part of arc-shaped bottom surfaces 72 located on the second side in the X direction.

The conductor 84 may be formed up to a region that is deeper than the depth d/2 as long as the region is positioned above the two-dot chain line Z. In other words, the lower edges of the common electrodes 74A and the active electrodes 74B, which are formed from the conductor 84 formed by oblique deposition, may be formed within a range that is positioned above the two-dot chain line Z as well as deeper than the depth d/2. The common electrodes 74A and the active electrode 74B are separated from the bottom surfaces of the liquid jet channels 12A and the dummy channels 12B which are formed from the grooves 83 (the upper surface of the nozzle plate 14 in this example), thereby achieving stable ejection of liquid droplets as described above.

Figure 12:
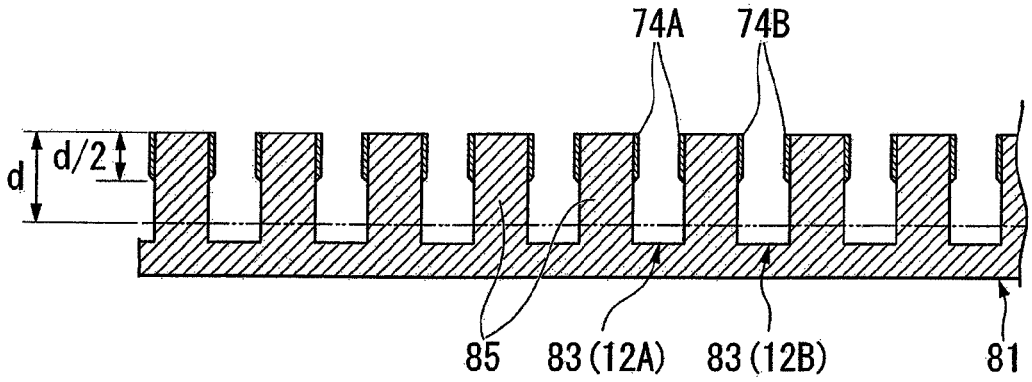
FIG. 12 is a cross-sectional view corresponding to FIG. 3 in an electrode forming step of the manufacturing method.

Referring to FIG. 12, in the electrode forming step S5, the conductor 84 is patterned to form the common electrodes 74A and the active electrodes 74B. That is, a part of the conductor 84 deposited on the upper surface of the resin film 82 is removed together with the resin film 82 by lift-off for removing the resin film 82. As a result, the conductor 84 deposited on opposing side surfaces of each of the walls 85 formed between the grooves 83 is separated into two parts to form the common electrode 74A and the active electrode 74B.

Figure 13:
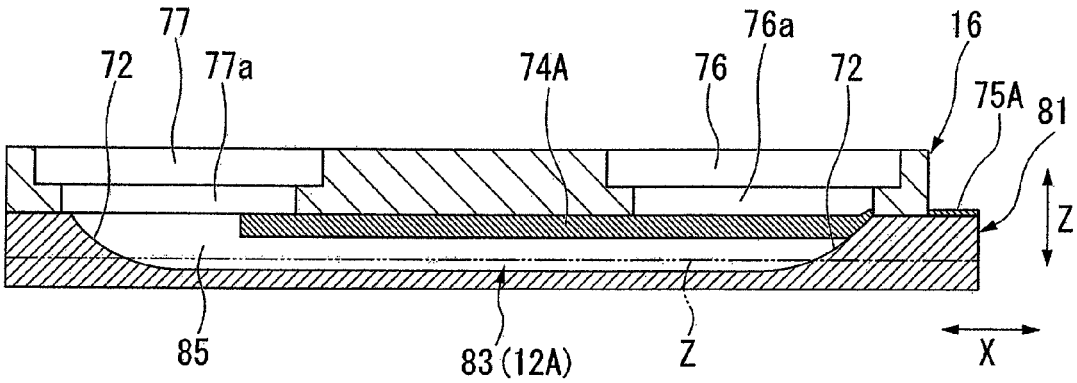
FIG. 13 is a cross-sectional view corresponding to FIG. 4 in a cover plate placing step of the manufacturing method.
Figure 14:
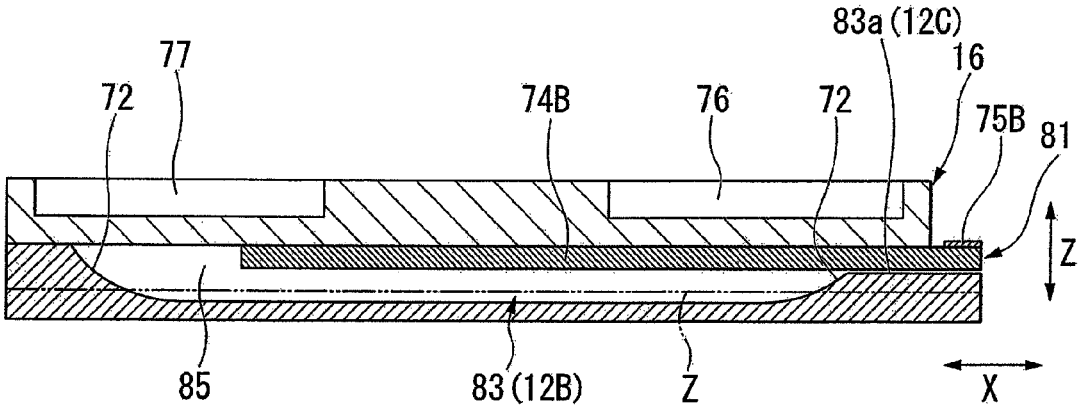
FIG. 14 is a cross-sectional view corresponding to FIG. 5 in the cover plate placing step of the manufacturing method.

In the electrode forming step S5, the common terminals 75A and the active terminals 75B are also formed at the same time of forming the common electrodes 74A and the active electrodes 74B (see FIGS. 13 and 14). At this point, in all of the common electrodes 74A which are formed on the opposing inner surfaces of the liquid jet channels 12A, a pair of common electrodes 74A located inside each of the liquid jet channels 12A are electrically connected to each other. On the other hand, in all of the active electrodes 74B which are formed on the opposing inner surfaces of the dummy channels 12B, a pair of active electrodes 74B located inside each of the dummy channels 12B are electrically separated from each other. However, a pair of active electrodes 74B, between which a liquid jet channel 12A is interposed, is electrically connected to each other. As a result, the walls 85 (piezoelectric bodies 17) which form the liquid jet channels 12A can be driven at the same time.

Referring to FIGS. 13 and 14, in the cover plate placing step S6, the cover plate 16 is bonded to the upper surface of the piezoelectric substrate 81 with adhesive or the like after the electrode forming step S5. As a result, the upper ends of the walls 85 formed between the grooves 83 of the piezoelectric substrate 81 are integrally coupled to each other through the cover plate 16.

Figure 15:
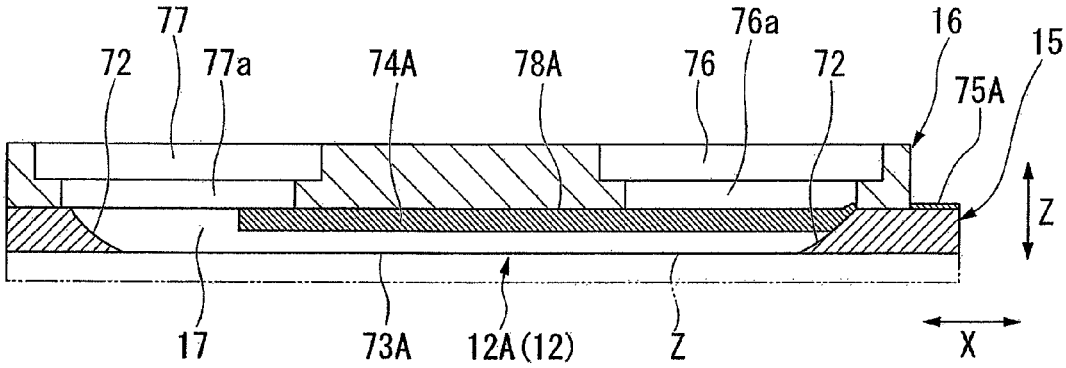
FIG. 15 is a cross-sectional view corresponding to FIG. 4 in a substrate grinding step of the manufacturing method.
Figure 16:
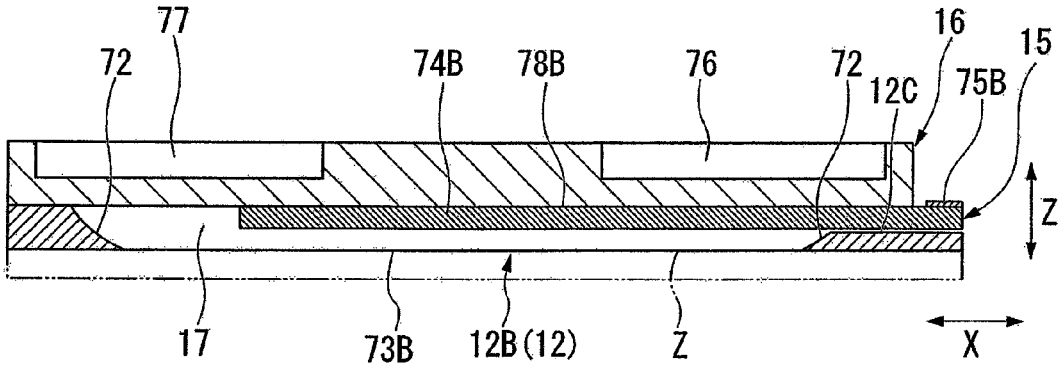
FIG. 16 is a cross-sectional view corresponding to FIG. 5 in the substrate grinding step of the manufacturing method.

Referring to FIGS. 15 and 16, in the substrate grinding step S7, the lower surface of the piezoelectric substrate 81 is ground up to a position indicated by the two-dot chain line Z. As a result, the grooves 83 penetrate the piezoelectric substrate 81 from the upper surface through the lower surface thereof, and are formed into the liquid jet channels 12A and the dummy channels 12B each having the depth d. At this point, the lower ends of the walls 85 formed between the grooves 83 are separated from each other. On the other hand, the upper ends of the walls 85 are coupled to each other by being bonding to the cover plate 16. In addition, the piezoelectric substrate 81 is left on both ends in the X direction of the grooves 83. Therefore, the piezoelectric substrate 81 is not disassembled in the substrate grinding step S7.

Hereinbelow, a method of determining a grinding amount G of a lower surface 81*b* of the piezoelectric substrate 81 in the substrate grinding step S7 will be described with reference to FIGS. 17A to 17D.

On both ends in the Y direction of a groove group 86 that includes the grooves 83, the inspection recessed portions 87 are formed adjacent to the outermost grooves 83 in the groove group 86. Each of the inspection recessed portions 87 is formed into a groove that is parallel to each of the grooves 83, and shallower than each of the grooves 83. The inspection recessed portions 87 are formed using the dicing blade 71 before or after forming the grooves 83 in the groove forming step S3. That is, in this example, the groove forming step S3 includes a recessed portion forming step S31 for forming the inspection recessed portions 87.

Each of the inspection recessed portions 87 is formed in such a manner that the dicing blade 71 moves downward from a position above the piezoelectric substrate 81 to a predetermined position on an upper surface 81*a* of the piezoelectric substrate 81 (on either side in the Y direction of the groove group 86), and a part of the piezoelectric substrate 81 on the predetermined position is ground up to a predetermined depth that is shallower than the depth of each of the grooves 83.

Figure 17A:
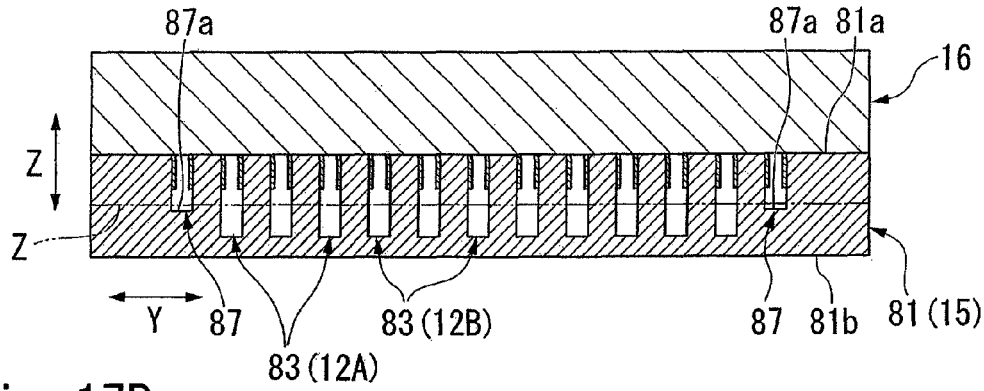
FIG. 17A is a cross-sectional view corresponding to FIG. 3 before the substrate grinding step of the manufacturing method.

Referring to FIG. 17A, the predetermined depth is slightly deeper than the final depth of the liquid jet channels 12A and the dummy channels 12B, the final depth being indicated by a two-dot chain line Z. Each of the inspection recessed portions 87 is formed merely by moving the dicing blade 71 up and down on the predetermined position on the upper surface 81*a* of the piezoelectric substrate 81. In each of the inspection recessed portions 87, an arc-shaped bottom surface 87*a* is formed along the outer peripheral shape of the dicing blade 71. By forming the inspection recessed portions 87 together with the grooves 83 in the grove forming step S3, an increase in the number of steps for manufacturing the head chip 41 is reduced. Further, the groove forming step S3 may not include the recessed portion forming step S31, and the recessed portion forming step S31 may be performed at a predetermined timing before the substrate grinding step S7.

Figure 17B:
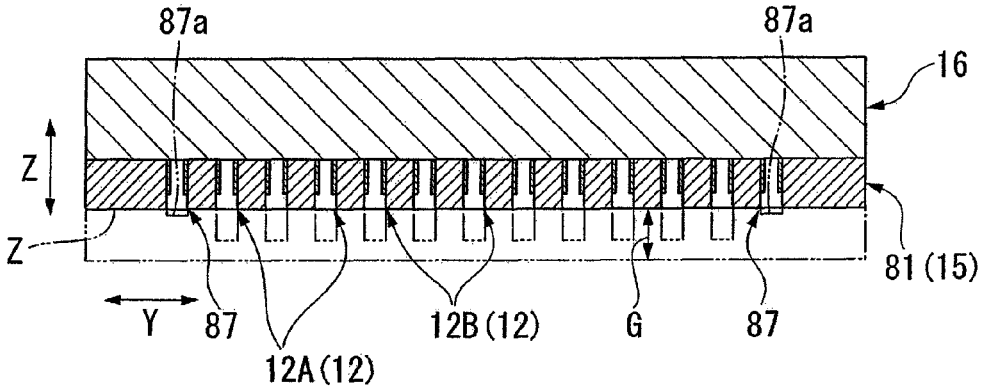
FIG. 17B is a cross-sectional view of FIG. 17A after the substrate grinding step.
Figure 17C:
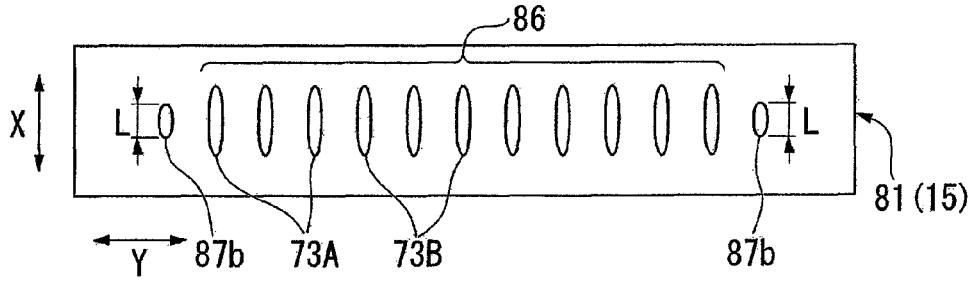
FIG. 17C is a bottom view of FIG. 17B.

Referring to FIGS. 17B and 17C, when the lower surface 81*b* of the piezoelectric substrate 81 is ground in the substrate grinding step S7, the bottoms of the respective grooves 83 are opened to form the lower openings 73A and 73B. Thereafter, when the piezoelectric substrate 81 is further ground up to the position indicated by the two-dot chain line Z, the bottoms of the respective inspection recessed portions 87, which are slightly deeper than the position indicated by the two-dot chain line Z, start being opened.

An opening width L in the X direction of a lower opening 87*b* of each of the inspection recessed portions 87 largely changes immediately after the grinding amount G of the piezoelectric substrate 81 reaches the lowest end of the arc-shaped bottom surface 87*a* of each of the inspection recessed portions 87 (immediately after grinding point reaches the lowest end of the arc-shaped bottom surface 87*a* of each of the inspection recessed portions 87) according to increase and decrease in the grinding amount G of the piezoelectric substrate 81. Whether or not the grinding amount G of the piezoelectric substrate 81 falls within an appropriate range (tolerance range) can be easily and accurately determined by determining whether or not the opening width L falls within a predetermined range (1 to 30% of the length of the grooves 83, for example).

Each of the inspection recessed portions 87 has the arc-shaped bottom surface 87*a* that causes the opening width L in the lower surface 81*b* to increase as the grinding amount G of the lower surface 81*b* of the piezoelectric substrate 81 increases. Therefore, the grinding amount G can be determined by the opening width L of each of the inspection recessed portions 87. The bottom surface of each of the inspection recessed portions 87 is not limited to the arc-shaped bottom surface 87*a*, and may be any forms such as an inclined bottom surface as long as it causes the opening width L in the lower surface 81*b* to increase as the grinding amount G of the lower surface 81*b* of the piezoelectric substrate 81 increases. The opening width L of each of the inspection recessed portions 87 in the lower surface 81*b* of the piezoelectric substrate 81 is continuously or intermittently observed by a sensor or eyesight during the substrate grinding step S7. In this case, the substrate grinding step S7 includes a grinding amount determination step S71 for determining whether or not the grinding amount G of the piezoelectric substrate 81 is appropriate by a state of each of the inspection recessed portions 87 viewed from underneath the lower surface 81*b* of the piezoelectric substrate 81. The substrate grinding step S7 may not include the grinding amount determination step S71, and the grinding amount determination step S71 may be performed at a predetermined timing after the substrate grinding step S7.

Since the inspection recessed portions 87 are arranged on the both ends in the arrangement direction (Y direction) of the groove group 86 so as to be separated from each other, an inclination of the piezoelectric substrate 81 can be detected. When the piezoelectric substrate 81 is inclined and the grinding amount G is thereby deviated, the depth of each of the ejection grooves changes, and variation in the ejection amount of ink thereby occurs. Therefore, the inspection recessed portions 87 are preferably arranged on both sides in the arrangement direction of the groove group 86 so as to be separated from each other. In particular, in order to reduce variation in the ejection amount of ink between the ejection grooves, the inspection recessed portions 87 are more preferably arranged on the both ends in the arrangement direction of the grooves 83 in the groove group 86.

Figure 17D:
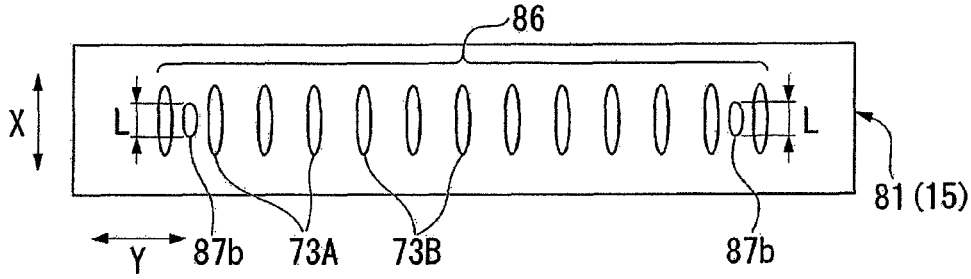
FIG. 17D is a bottom view of FIG. 17B having a different arrangement of inspection recessed portions.

When the inspection recessed portions 87 are arranged outside the groove group 86 in adjacent to the outermost grooves 83 in the groove group 86 as shown in FIG. 17C, deviation of the grinding amount G can be inspected in an excellent manner. On the other hand, when the inspection recessed portions 87 are arranged inside the groove group 86 in adjacent to the outermost grooves 83 in the groove group 86 as shown in FIG. 17D, a wide forming range of the groove group 86 can be ensured. The inspection recessed portions 87 may be formed on both ends in the longitudinal direction (X direction) of the grooves 83 in the groove group 86, or may be arranged on both ends in the diagonal direction of the groove group 86. Each of the inspection recessed portions 87 is not limited to a groove, and may be various bottomed recessed portions. Each of the inspection recessed portions 87 may not have a bottomed shape as long as is can change its state viewed from underneath the lower surface 81 of the piezoelectric substrate 81 (for, example, change the opening width L).

Figure 18A:
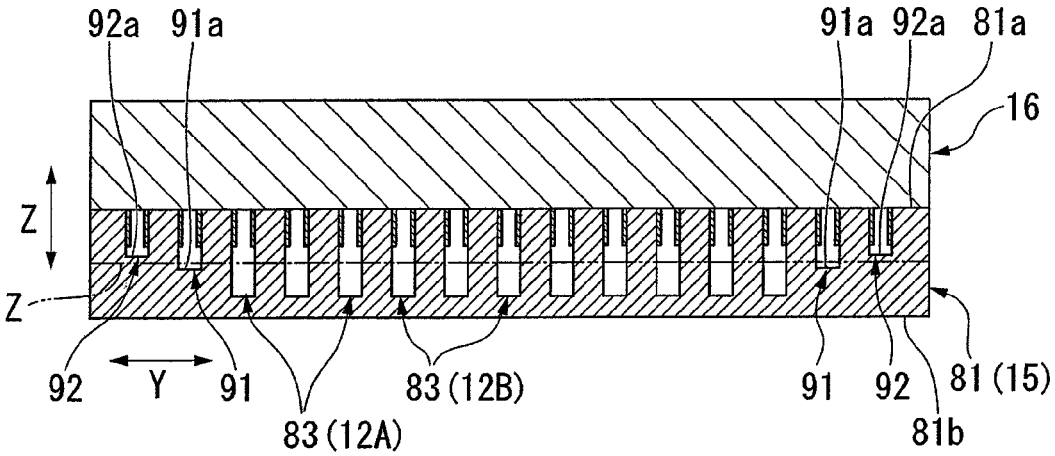
FIG. 18A is a cross-sectional view corresponding to FIG. 3 before the substrate grinding step of a first modified example of the manufacturing method.
Figure 18B:
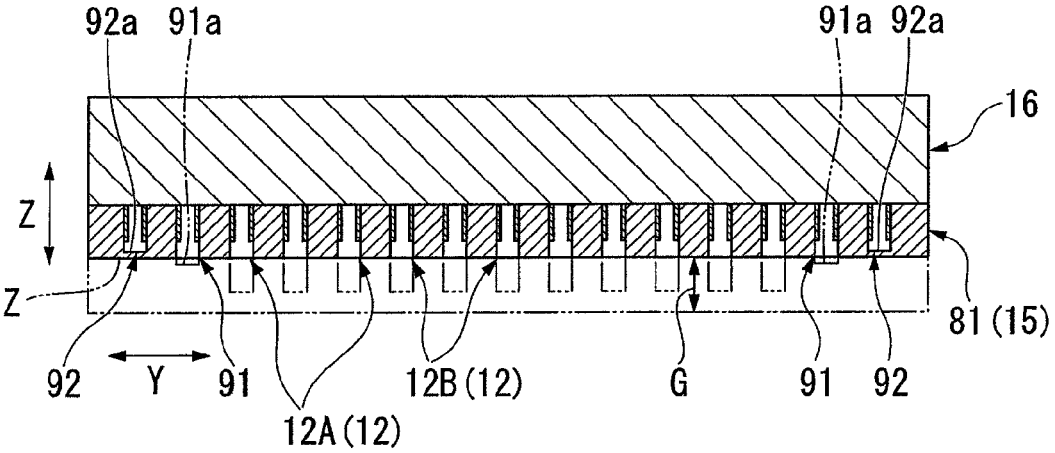
FIG. 18B is a cross-sectional view of FIG. 18A after the substrate grinding step.
Figure 18C:
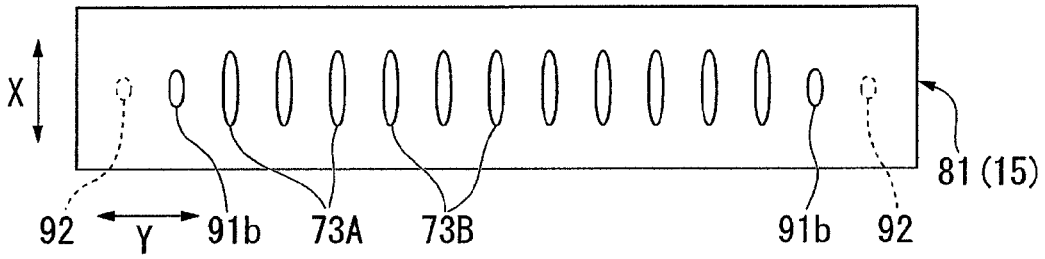
FIG. 18C is a bottom view of FIG. 18B.

FIGS. 18A to 18C illustrate, as a first modified example of the present embodiment, an example in which first inspection recessed portions 91 and second inspection recessed portions 92 are formed on both ends in the Y direction of the groove group 86. Each of the first inspection recessed portions 91 has a first bottom surface 91*a* which is opened when the grinding amount G of the lower surface 81*b* of the piezoelectric substrate 81 reaches a lower limit of the tolerance range thereof. On the other hand, each of the second inspection recessed portions 92 has a second bottom surface 92*a* which is not opened (remains closed) even when the grinding amount G of the lower surface 81*b* of the piezoelectric substrate 81 reaches an upper limit of the tolerance range thereof.

In this case, in the substrate grinding step S7, the first inspection recessed portions 91 are made opened and the second inspection recessed portions 92 made to remain closed. As a result, it is possible to more easily determine that the grinding amount G of the piezoelectric substrate 81 falls within an appropriate range.

Figure 19A:
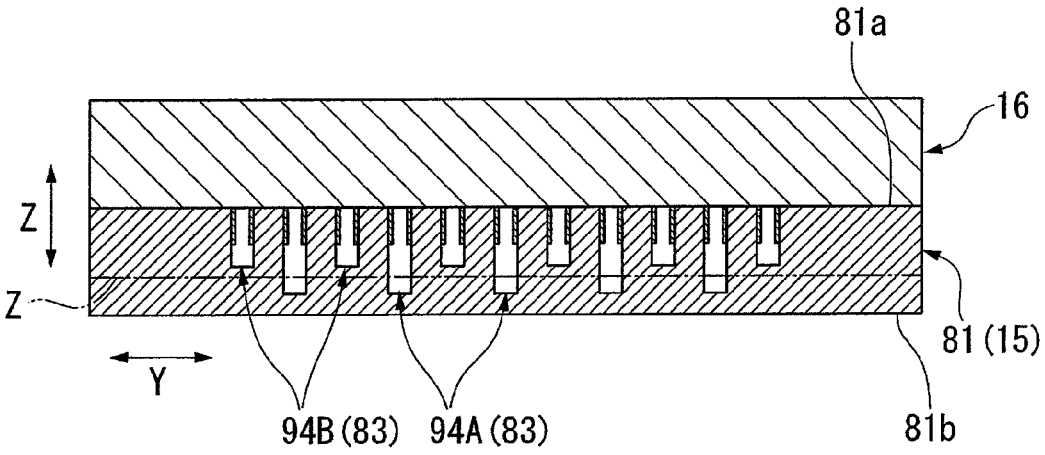
FIG. 19 is a cross-sectional view corresponding to FIG. 3 before the substrate grinding step of a second modified example of the manufacturing method.
FIG. 19B is a cross-sectional view of FIG. 19A after the substrate grinding step.
FIG. 19C is a bottom view of FIG. 19B.
Figure 19B:
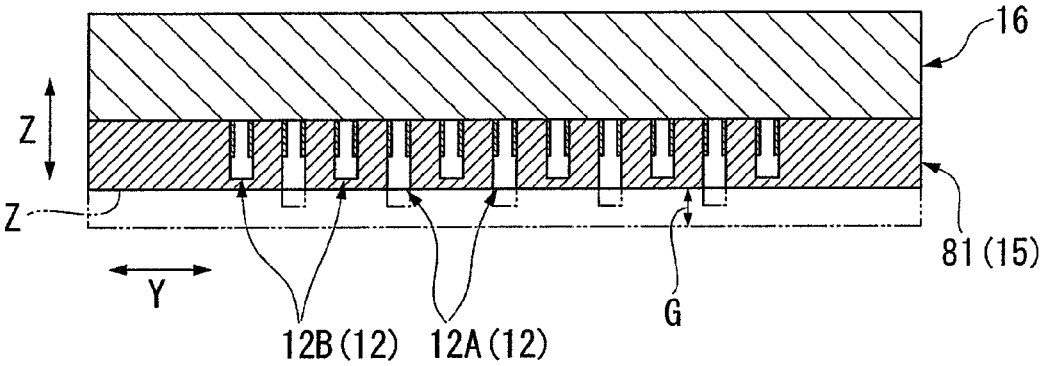
Figure 19C:
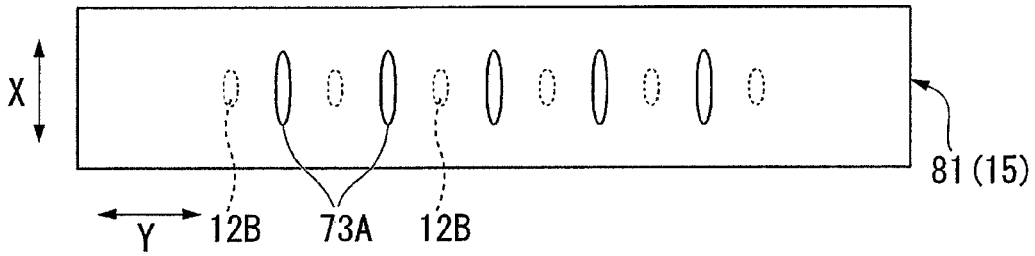

FIGS. 19A to 19C illustrate, as a second modified example of the present embodiment, an example in which the grooves 83 are classified into first grooves 94A which are the bases of the liquid jet channels 12A and second grooves 94B which are the bases of the dummy channels 12B, and the second grooves 94B are formed to have the predetermined depth as the inspection recessed portions.

In this case, since the groove forming step S3 also serves as the recessed portion forming step S31, it is possible to reduce the man-hour for manufacturing the head chip 41 and ensure a wide forming range of the groove group 86 in comparison with the case where dedicated inspection recessed portions are provided.

In FIGS. 19A to 19C, all of the second grooves 94B are formed to have the predetermined depth. However, only some of the second grooves 94B (second grooves 94B located on the both ends of the groove group 86, for example) may be used as the inspection recessed portions. Further, at least a pair of the second grooves 94B may be set as the inspection recessed portions, and these second grooves 94B may be formed to have two stages of depth in the same manner as the first and second inspection recessed portions 91 and 92 in FIGS. 18A to 18C.

Figure 20A:
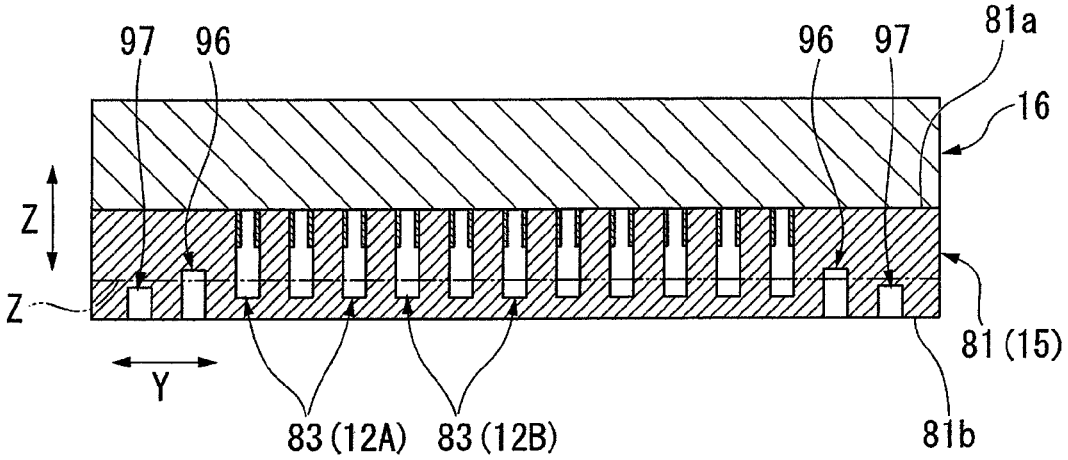
FIG. 20 is a cross-sectional view corresponding to FIG. 3 before the substrate grinding step of a third modified example of the manufacturing method.
FIG. 20B is a cross-sectional view of FIG. 20A after the substrate grinding step.
FIG. 20C is a bottom view of FIG. 20B.
Figure 20B:
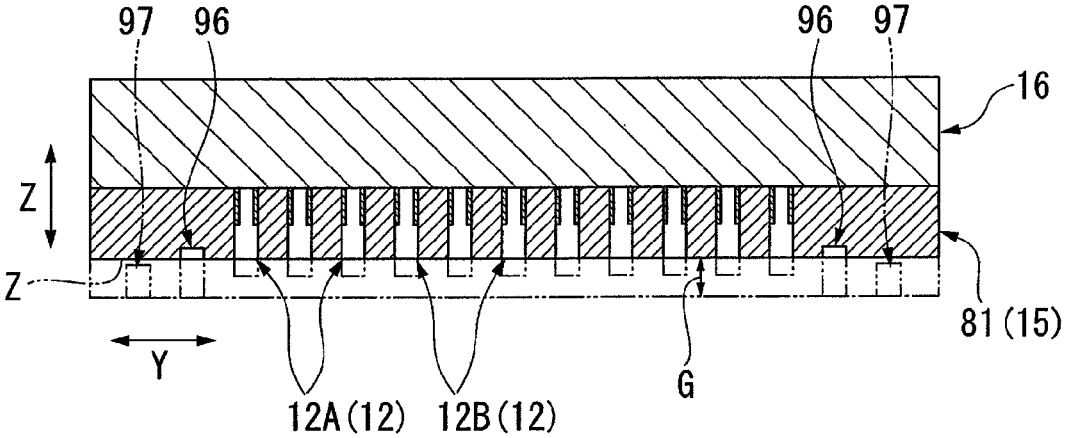
Figure 20C:
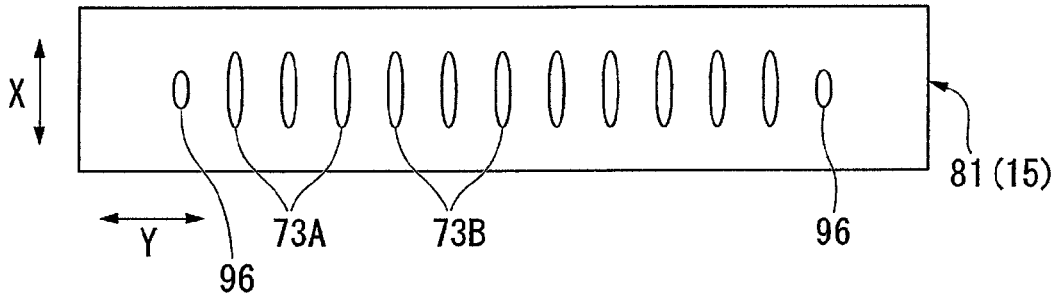

FIGS. 20A to 20C illustrate, as a third modified example of the present embodiment, an example in which lower inspection recessed portions 96 and 97 are formed on the lower surface 81*b* of the piezoelectric substrate 81.

The lower inspection recessed portions 96 and 97 include first lower inspection recessed portions 96, each of which disappears when the grinding amount G of the lower surface 81*b* of the piezoelectric substrate 81 reaches the lower limit of the tolerance range thereof, and second inspection recessed portions 97, each of which remains to exist even when the grinding amount G of the lower surface 81*b* of the piezoelectric substrate 81 reaches the upper limit of the tolerance range thereof.

In this case, by grinding the piezoelectric substrate 81 until the first lower inspection recessed potions 96 disappear, but the second lower inspection recessed portions 97 remain exist, it is possible to easily determine that the grinding amount G of the piezoelectric substrate 81 falls within an appropriate range. The recessed portion forming step S31 for forming the lower inspection recessed portions 96 and 97 and the groove forming step S3 are performed as separate steps.

As described above, the method of manufacturing the head chip in the above embodiment includes the groove forming step S3 for forming the grooves 83 which are the bases of the liquid jet channels 12A on the upper surface 81*a* of the piezoelectric substrate 81; the substrate grinding step S7 for grinding the lower surface 81*b* of the piezoelectric substrate 81 so that each of the grooves 83 has a predetermined depth; the recessed portion forming step S31 for forming the inspection recessed portion which changes its state in the lower surface 81*b* of the piezoelectric substrate 81 according to the grinding amount G of the piezoelectric substrate 81 in the substrate grinding step S7; and the grinding amount determination step S71 for determining the grinding amount G of the piezoelectric substrate 81 on the basis of a state of the inspection recessed portion viewed from underneath the lower surface 81*b* of the piezoelectric substrate 81 after the substrate grinding step S7.

With such a configuration, it is possible to easily inspect whether or not the grinding amount G of the piezoelectric substrate 81 is appropriate as well as whether or not the depth of each of the ejection grooves is appropriate without inspecting the thickness of the piezoelectric substrate 81 and the depth of each of the ejection grooves after grinding the lower surface 81*b* of the piezoelectric substrate 81 using inspection equipment or the like. Since the grinding amount G of the piezoelectric substrate 81 can be easily inspected in this manner, it is possible to reduce variation in the depth of the ejection grooves and achieve an excellent liquid ejection performance while preventing an increase in the man-hour for manufacturing the head chip 41. When the inspection recessed portions are provided on both sides in the longitudinal direction of the piezoelectric substrate 81, variation in the depth of the grooves due to an inclination of the piezoelectric substrate 81 can also be easily detected.

Note that the present invention is not limited to the above embodiment. For example, the head chip 41 may be applied not only to the ink jet type liquid jet head 4 which ejects ink droplets onto a recording paper or the like to record a character and a figure thereon, but also to a liquid jet head that ejects a liquid material onto the surface of an element substrate to form a functional thin film thereon.

The configuration in the above embodiment is merely an example of the present invention. Therefore, various modifications can be made without departing from the scope of the invention.

What is claimed is:

1. A method of manufacturing a head chip, the head chip comprising an actuator plate having a plurality of ejection grooves arranged on a first surface of an actuator substrate, each of the grooves having a depth penetrating the actuator substrate, and a nozzle plate placed on a second surface of the actuator plate, the nozzle plate having a plurality of nozzle holes arranged thereon, each of the nozzle holes communicating with a middle part in the longitudinal direction of each of the ejection grooves, the method comprising:

a groove forming step for forming grooves which are bases of the ejection grooves on the first surface of the actuator substrate;

a substrate grinding step for grinding a second surface of the actuator substrate so that each of the grooves has a predetermined depth;

a recessed portion forming step for forming at least one inspection recessed portion on the actuator substrate, the at least one inspection recessed portion changing its state in the second surface of the actuator substrate according to a grinding amount of the actuator substrate in the substrate grinding step; and a grinding amount determination step for determining the grinding amount of the actuator substrate on the basis of a state of the at least one inspection recessed portion after the substrate grinding step.

2. The method of manufacturing a head chip according to claim 1, wherein the at least one inspection recessed portion comprises a plurality of inspection recessed portions, and the inspection recessed portions are formed on both sides in an arrangement direction of the grooves of a groove group including the grooves.

3. The method of manufacturing a head chip according to claim 2, wherein the inspection recessed portions are formed outside outermost grooves of the groove group.

4. The method of manufacturing a head chip according to claim 2, wherein the inspection recessed portions are formed inside the outermost grooves of the grove group.

5. The method of manufacturing a head chip according to claim 1, wherein the at least one inspection recessed portion is formed on the first surface of the actuator substrate.

6. The method of manufacturing a head chip according to claim 5, wherein the at least one inspection recessed portion has a bottom that causes an opening width thereof in the second surface of the actuator substrate to increase as the grinding amount of the actuator substrate increases, and the grinding amount of the actuator substrate is determined on the basis of the opening width of the at least one inspection recessed portion in the second surface of the actuator substrate.

7. The method of manufacturing a head chip according to claim 5, wherein the at least one inspection recessed portion includes a first recessed portion whose bottom is opened when the grinding amount of the actuator substrate reaches a minimum value thereof and a second recessed portion whose bottom remains closed even when the grinding amount of the actuator substrate reaches a maximum value thereof.

8. The method of manufacturing a head chip according to claim 5, wherein the at least one inspection recessed portion is a second groove which is a base of a non-ejection groove alternately arranged with the ejection groove.

9. The method of manufacturing a head chip according to claim 1, wherein the at least one inspection recessed portion is formed on the second surface of the actuator substrate.

10. The method of manufacturing a head chip according to claim 9, wherein the at least one inspection recessed portion includes a second side first recessed portion which disappears when the grinding amount of the actuator substrate reaches a minimum value thereof and a second side second recessed portion which remains to exist even when the grinding amount of the actuator substrate reaches a maximum value thereof.

* * * * *